US010030287B2

(12) United States Patent
Aoyama et al.

(10) Patent No.: US 10,030,287 B2
(45) **Date of Patent: *Jul. 24, 2018**

(54) SOFT-DILUTE-COPPER-ALLOY MATERIAL, SOFT-DILUTE-COPPER-ALLOY WIRE, SOFT-DILUTE-COPPER-ALLOY SHEET, SOFT-DILUTE-COPPER-ALLOY STRANDED WIRE, AND CABLE, COAXIAL CABLE AND COMPOSITE CABLE USING SAME

(75) Inventors: Seigi Aoyama, Kitaibaraki (JP); Toru Sumi, Hitachi (JP); Hiromitsu Kuroda, Hitachi (JP); Hideyuki Sagawa, Tokai-mura (JP)

(73) Assignee: HITACHI METALS, LTD., Tokyo (JP)

( * ) Notice: Subject to any disclaimer, the term of this patent is extended or adjusted under 35 U.S.C. 154(b) by 390 days.

This patent is subject to a terminal disclaimer.

(21) Appl. No.: 13/577,400

(22) PCT Filed: Feb. 8, 2011

(86) PCT No.: PCT/JP2011/052663

§ 371 (c)(1),
(2), (4) Date: Aug. 6, 2012

(87) PCT Pub. No.: WO2011/096576

PCT Pub. Date: Aug. 11, 2011

(65) Prior Publication Data

US 2012/0305286 A1 Dec. 6, 2012

(30) Foreign Application Priority Data

Feb. 8, 2010 (JP) ..... 2010-025353
Oct. 20, 2010 (JP) ..... 2010-235269

(51) Int. Cl.
*C22C 9/00* (2006.01)
*C22F 1/08* (2006.01)
(Continued)

(52) U.S. Cl.
CPC ..... *C22C 9/00* (2013.01); *B21C 1/003* (2013.01); *C22C 1/10* (2013.01); *C22F 1/08* (2013.01); *H01B 1/026* (2013.01)

(58) Field of Classification Search
CPC ..... C22C 9/00; C22C 1/10; B22D 21/025; B22D 11/004; H01B 1/026; C22F 1/08; B21C 1/003
(Continued)

(56) References Cited

U.S. PATENT DOCUMENTS 2,622,152 A * 12/1952 Rosch ..... 333/243
4,389,250 A * 6/1983 Melton et al. ..... 75/232
(Continued)

FOREIGN PATENT DOCUMENTS

CN 1384216 A 12/2002
CN 101864530 A 10/2010
(Continued)

OTHER PUBLICATIONS

International Search Report in PCT/JP2011/052663 dated May 10, 2011 (English Translation Thereof).
(Continued)

*Primary Examiner* — Keith Walker
*Assistant Examiner* — John A Hevey
(74) *Attorney, Agent, or Firm* — McGinn IP Law Group, PLLC

(57) ABSTRACT

A soft dilute copper alloy material includes 2 mass ppm to 12 mass ppm of sulfur, more than 2 mass ppm and not more than 30 mass ppm of oxygen, 4 mass ppm to 55 mass ppm of Ti, and a balance including copper. An average crystal grain size is not more than 20 μm in a surface layer up to a depth of 50 μm from a surface. The average crystal grain size
(Continued)

in the surface layer is less than the average crystal grain size in an inner portion located more interiorly than the surface layer.

21 Claims, 18 Drawing Sheets

(51) Int. Cl.
*H01B 1/02* (2006.01)
*B21C 1/00* (2006.01)
*C22C 1/10* (2006.01)

(58) Field of Classification Search
USPC ..... 148/432–436; 420/492, 500; 174/68.1, 174/251, 71 C, 102 R, 106 R
See application file for complete search history.

(56) References Cited

U.S. PATENT DOCUMENTS

| | | | | |
|---|---|---|---|---|
| 5,077,005 | A * | 12/1991 | Kato | 420/469 |
| 6,077,364 | A | 6/2000 | Chandler et al. | |
| 6,197,433 | B1 * | 3/2001 | Hatano | B21B 1/40 148/411 |
| 6,894,226 | B2 * | 5/2005 | Yokoi | H01B 11/183 174/102 R |
| 8,779,294 | B2 | 7/2014 | Sumi | |
| 8,835,766 | B2 | 9/2014 | Aoyama | |
| 9,234,263 | B2 | 1/2016 | Kuroda | |
| 9,293,231 | B2 | 3/2016 | Aoyama | |
| 9,734,937 | B2 * | 8/2017 | Aoyama | H01B 1/026 |
| 2002/0157741 | A1 | 10/2002 | Yamamoto et al. | |
| 2006/0157167 | A1 | 7/2006 | Kuroda | |
| 2007/0015001 | A1 * | 1/2007 | Uno et al. | 428/655 |
| 2010/0263905 | A1 | 10/2010 | Aoyama | |
| 2013/0022831 | A1 * | 1/2013 | Sagawa | H01B 1/026 428/606 |
| 2014/0000932 | A1 | 1/2014 | Aoyama | |

FOREIGN PATENT DOCUMENTS

| | | | | |
|---|---|---|---|---|
| JP | 54063284 | A | * | 5/1979 |
| JP | 01198457 | A | * | 8/1989 |
| JP | 06-179932 | A | | 6/1994 |
| JP | 09-157775 | A | | 6/1997 |
| JP | 09-256084 | A | | 9/1997 |
| JP | 2002-294369 | A | | 10/2002 |
| JP | 2002-363668 | A | | 12/2002 |
| JP | 2006-274383 | A | | 10/2006 |
| JP | 2006274384 | A | * | 12/2006 |
| JP | 2008-001933 | A | | 1/2008 |
| JP | 2008-041447 | A | | 2/2008 |
| JP | 2010-265511 | | | 11/2010 |

OTHER PUBLICATIONS

Office Action of the counterpart Japanese patent application dated Jul. 19, 2012 ( with English translation thereof), PCT/JP2011/052663.

U.S. Office Action dated Dec. 18, 2012 in co-pending related U.S. Appl. No. 13/553,762.

U.S. Office Action dated Jun. 5, 2013 in U.S. Appl. No. 13/553,762.

Japanese Office Action dated May 7, 2013 with an English translation, Application No. 2010-235268.

Seigi Aoyama, et al. "Effects of Hot-Working Processes and Impurities on the Properties of Cold-Drawn Cu Wires", The Journal of the Japan Institute of Metals, vol. 51, No. 9 (1987), pp. 858-863.

Chinese Office Action dated Jun. 3, 2015 with partial English translation, application No. 201210252581.9.

United States Office Action dated Feb. 28, 2017 in U.S. Appl. No. 13/317,461.

United States Office Action dated Feb. 24, 2017, in U.S. Appl. No. 13/553,762.

* cited by examiner

SOFT-DILUTE-COPPER-ALLOY MATERIAL, SOFT-DILUTE-COPPER-ALLOY WIRE, SOFT-DILUTE-COPPER-ALLOY SHEET, SOFT-DILUTE-COPPER-ALLOY STRANDED WIRE, AND CABLE, COAXIAL CABLE AND COMPOSITE CABLE USING SAME

BACKGROUND OF THE INVENTION

1. Field of the Invention

The present application is based on Japanese Patent Applications No. 2010-25353 filed on Feb. 8, 2010 and No. 2010-235269 filed on Oct. 20, 2010, the entire contents of which are incorporated herein by reference.

The invention relates to a soft dilute copper alloy material having high conductivity and a long bending life even though it is a soft material, a soft dilute copper alloy wire, soft dilute copper alloy sheet, a soft dilute copper alloy stranded wire, and a cable, a coaxial cable and a composite cable using the same.

2. Description of the Related Art

In recent science and technology, electricity is used for everything such as electric power as a power source or electric signals, etc., and conductors such as cables or lead wires are used for transmission thereof. Metals having high conductivity such as copper (Cu) or silver (Ag) are used as a material of such conductors, and particularly, copper wires are used very often in view of the cost.

Although it is generically called "copper", it is broadly classified into hard copper and soft copper depending on a molecular arrangement thereof. In addition, various types of copper having desired properties are used depending on the intended use.

A hard copper wire is often used for a lead wire for electronic component. Meanwhile, a cable used in electronic devices, etc., such as medical equipment, industrial robot or notebook computer is used in an environment in which a combined external force of extreme bending, torsion and tension, etc., is repeatedly applied. Therefore, a rigid hard copper wire is unsuitable as such a cable and a soft copper wire is used instead.

A conductor used for such an application is required to have conflicting characteristics, which are good conductivity (high conductivity) and good bending characteristics. Accordingly, a copper material maintaining high conductivity and flexibility has been developed to date (see JP-A 2002-363668 and JP-A 9-256084).

For example, JP-A 2002-363668 relates to a flexible cable conductor having good tensile strength, elongation properties and conductivity, and particularly, a flexible cable conductor is described in which a wire rod is formed of a copper alloy made of oxygen-free copper (OFC) with a purity of not less than 99.99 wt % containing indium (In) with a purity of not less than 99.99 wt % at a concentration range of 0.05 to 0.70 mass % and phosphorus (P) with a purity of not less than 99.9 wt % at a concentration range of 0.0001 to 0.003 mass %.

Meanwhile, JP-A 9-256084 describes a flexible copper alloy wire containing 0.1 to 1.0 wt % of indium (In), 0.01 to 0.1 wt % of boron (B) and copper (Cu) as the remainder.

However, in JP-A 2002-363668 which discloses the invention only related to a hard copper wire, flexibility is not specifically evaluated. A soft copper wire having better flexibility is not examined at all. In addition, the invention described in JP-A 2002-363668 has a disadvantage in that conductivity is low due to the large amount of additional elements. Therefore, it cannot be considered that the soft copper wire is sufficiently examined in JP-A 2002-363668. Meanwhile, JP-A 9-256084 which discloses the invention related to a soft copper wire also has a disadvantage in that conductivity is low due to the large amount of additional elements in the same manner as the hard copper wire described in JP-A 2002-363668.

On the other hand, it is considered that high conductivity is ensured by selecting a highly conductive copper material such as oxygen-free copper (OFC), etc., as a raw copper material.

In addition, when oxygen-free copper (OFC) is used as raw material without adding any other elements in order to maintain high conductivity, a crystalline structure in the oxygen-free copper wire can be made finer by drawing a copper wire rod at an increased compression ratio so as to improve flexibility. The copper alloy material made by such a method is work-hardened due to the wire drawing process and is thus suitable for application as a hard wire rod. However, there is a problem that such a copper alloy material cannot be used for a soft wire rod.

SUMMARY OF THE INVENTION

Therefore, it is an object of the invention to provide a soft dilute copper alloy material having high conductivity and a long bending life even though it is a soft copper material, a soft dilute copper alloy wire, soft dilute copper alloy sheet, a soft dilute copper alloy stranded wire, and a cable, a coaxial cable and a composite cable using the same.

(1) According to one embodiment of the invention, a soft dilute copper alloy material comprises: copper; at least one additional element selected from the group consisting of Mg, Zr, Nb, Ca, V, Ni, Mn and Cr; and a balance consisting of an inevitable impurity, wherein an average crystal grain size is not more than 20 μm in a surface layer up to a depth of 50 μm from a surface.

(2) A crystalline structure of the soft dilute copper alloy material may comprise a recrystallized structure having a grain size distribution in which a crystal grain in the surface layer is smaller than a crystal grain of an inner portion.

(3) The soft dilute copper alloy material may further comprise 2 to 12 mass ppm of sulfur, more than 2 and not more than 30 mass ppm of oxygen and 4 to 55 mass ppm of Ti.

(4) The Ti may be present precipitated in a crystal grain or at a crystal grain boundary of copper in the form of any one of TiO, $TiO_2$, TiS and Ti—O—S.

(5) A portion of the sulfur and the Ti may compose a compound or an aggregate in the form of the TiO, the $TiO_2$, the TiS or the Ti—O—S, and the rest of the sulfur and the Ti may be present in the form of a solid solution.

(6) Preferably, the TiO with a size of not more than 200 nm, the $TiO_2$ with a size of not more than 1000 nm, the TiS with a size of not more than 200 nm or the Ti—O—S with a size of not more than 300 nm is distributed in the crystal grain, and the percentage of particles of not more than 500 nm is not less than 90%.

(7) According to another embodiment of the invention, a soft dilute copper alloy wire comprises the soft dilute copper alloy material defined by the above (1).

(8) A wire rod comprising the soft dilute copper alloy material may be drawn into the wire rod so as to have a conductivity of not less than 98% IACS.

(9) Preferably, a softening temperature of the wire with a diameter of 2.6 mm is 130° C. to 148° C.

(10) A plated layer may be formed on the surface.

(11) According to another embodiment of the invention, a soft dilute copper alloy stranded wire may comprise a plurality of ones of the soft dilute copper alloy wire defined by the above (7) being stranded.

(12) According to another embodiment of the invention, a cable may comprise: the soft dilute copper alloy wire defined by the above (7) or the soft dilute copper alloy stranded wire defined by the above (11); and an insulation layer around the wire.

(13) According to another embodiment of the invention, a coaxial cable may comprise: a central conductor formed with a plurality of ones of the soft dilute copper alloy wire defined by the above (7) being stranded; an insulation covering formed on an outer periphery of the central conductor; an outer conductor comprising copper or copper alloy arranged on an outer periphery of the insulation covering; and a jacket layer on an outer periphery of the outer conductor.

(14) According to another embodiment of the invention, a composite cable may comprise: a plurality of ones of the cable defined by the above (12) arranged in a shield layer; and a sheath on an outer periphery of the shield layer.

(15) According to another embodiment of the invention, a soft dilute copper alloy sheet may comprise the soft dilute copper alloy material defined by the above (1).

(16) A soft dilute copper alloy sheet may comprise the soft dilute copper alloy material defined by the above (1) being shaped and annealed.

(17) A crystalline structure of the soft dilute copper alloy material may comprise a recrystallized structure having a grain size distribution in which a crystal grain in the surface layer is smaller than a crystal grain of an inner portion.

(18) Preferably, the soft dilute copper alloy material may further comprise 2 to 12 mass ppm of sulfur, more than 2 and not more than 30 mass ppm of oxygen and 4 to 55 mass ppm of Ti.

(19) A portion of the sulfur and the Ti may compose a compound or an aggregate in the form of the TiO, the $TiO_2$, the TiS or the Ti—O—S, and the rest of the sulfur and the Ti may he present in the form of a solid solution.

(20) Preferably, the TiO with a size of not more than 200 nm, the $TiO_2$ with a size of not more than 1000 nm, the TiS with a size of not more than 200 nm or the Ti—O—S with a size of not more than 300 nm is distributed in the crystal grain, and the percentage of particles of not more than 500 nm is not less than 90%.

Effects of the Invention

According to one embodiment of the invention, a soft dilute copper alloy material can be provided that has high conductivity and a long bending life even though it is a soft material.

Points of the Invention

According to one embodiment of the invention, a soft dilute copper alloy material may comprise copper, at least one additional element selected from the group consisting of Ti, Mg, Zr, Nb, Ca, V, Ni, Mn and Cr and a balance consisting of an inevitable impurity, wherein an average crystal grain size is not more than 20 μm in a surface layer up to a depth of 50 μm from a surface. The development direction of cracks is easily changed by the fine average crystal grain size in the surface layer, so that the development of cracks can be prevented due to the repeated bends. Therefore, a soft copper material with a high conductivity and a long bending life can be provided.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Figure 1:
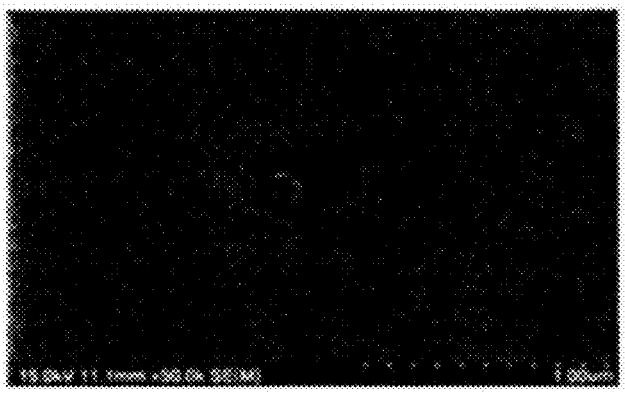
FIG. 1 is a SEM image showing a TiS particle.

A preferred embodiment of the invention will be described in detail below.

A soft dilute copper alloy material of the present embodiment is composed of copper, at least one additional element selected from the group consisting of Ti, Mg, Zr, Nb, Ca, V, Ni, Mn and Cr and a balance consisting of an inevitable impurity, and an average crystal grain size thereof is not more than 20 μm in a surface layer up to a depth of 50 μm from a surface.

Definition of Terms

In the present application, "size" of a compound means a long diameter of the compound in a shape having long and short diameters. A "crystal grain" means a crystalline structure of copper. A "crystal grain size" means a long diameter of each shape of a copper crystalline structure. An "average crystal grain size" is an average of actual measured values of the crystal grain size and, in this regard, the measurement method thereof will be described later. A "particle" means a particle of a compound such as TiO, $TiO_2$, TiS and Ti—O—S. In addition, a "percentage of particles" indicates a ratio of the number of such particles to the total number of particles including a crystalline structure of copper.

Object of the Invention

Firstly, an object of the invention is to obtain a soft dilute copper alloy material as a soft copper material which satisfies a conductivity of 98% IACS (International Annealed Copper Standard, conductivity is defined as 100% when resistivity is $1.7241\times10^{-8}$ Ωm), 100% IACS, or further, 102% IACS.

In addition, another object of the invention is to obtain a soft dilute copper alloy material which can be stably produced in a wide range of manufacturing with less generation of surface flaws by using a SCR (Southwire Continuous Rod System) continuous casting and rolling machine.

Still another object of the invention is to obtain a soft dilute copper alloy material having a softening temperature of not more than 148° C. when a compression ratio of a wire rod is 90% (e.g., processing from an 8 mm diameter wire into a 2.6 mm diameter wire).

Conductivity of Soft Dilute Copper Alloy Material

For the industrial use of the soft dilute copper alloy material, a conductivity of not less than 98% IACS is required when it is in the form of soft copper wire which is formed of electrolyte copper and has industrially usable purity. The conductivity of oxygen-free copper (OFC) is about 101.7% IACS and that of high purity copper (6N, a purity of 99.9999%) is 102.8% IACS, and therefore, it is desirable to have a conductivity as close to high purity copper (6N) as possible.

Softening Temperature of Soft Dilute Copper Alloy Material

It is desirable that a softening temperature of the soft dilute copper alloy material be not more than 148° C. in light of the industrial value thereof. The softening temperature of high purity copper (6N) is 127 to 130° C. As an example, the softening temperature at the compression ratio of 90% is 130° C. for high purity copper (6N). Therefore, the lower limit of the softening temperature is determined to 130° C. based on the obtained data.

Therefore, a soft dilute copper alloy material having a conductivity of not less than 98% IACS, not less than 100% IACS, or further, not less than 102% IACS at a softening temperature of not less than 130° C. and not more than 148° C. allowing stable production and the manufacturing conditions allowing stable manufacturing thereof were examined.

Firstly, an 8 mm diameter wire rod, which is formed of molten copper of high purity copper (4N, a purity of 99.99%) with an oxygen (O) concentration of 1 to 2 mass ppm and having several mass ppm of titanium (Ti) added thereto, was processed to have a diameter of 2.6 mm (at a compression ratio of 90%) by using a small continuous casting machine in an experimental laboratory. The measured softening temperature of the wire rod after cold wire drawing process was 160 to 168° C. and could not be lower than 160° C. In addition, the conductivity was about 101.7% IACS. Therefore, it was found that, even though the O concentration is reduced and Ti is added, it is not possible to lower the softening temperature and the conductivity is poorer than that of high purity copper (6N) which is 102.8% IACS.

It is presumed that the softening temperature is not lowered because, although several mass ppm or more of S is mixed as an inevitable impurity during manufacturing of the molten copper, sulfide such as TiS, etc., is not sufficiently formed by this S and Ti.

Accordingly, two measures were examined in the present embodiment in order to lower the softening temperature after the cold wire drawing process and to improve the conductivity, and the object was achieved by combining effects of the two measures.

(a) Oxygen Concentration

Figure 2:
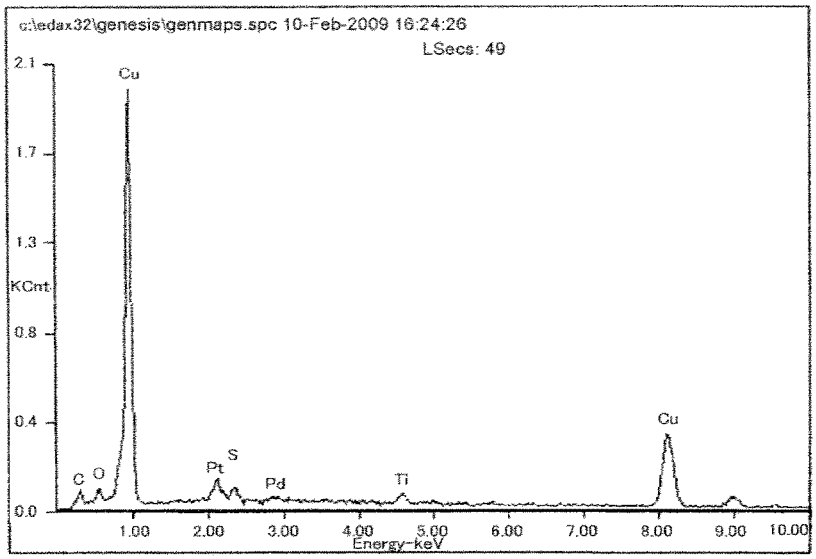
FIG. 2 is a graph showing a result of analysis of FIG. 1.
Figure 3:
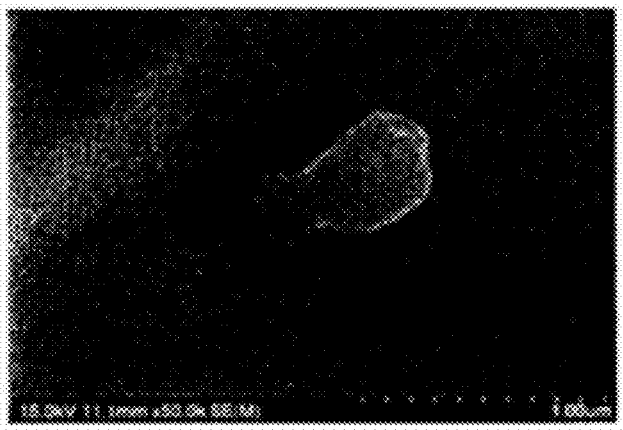
FIG. 3 is a SEM image showing a $TiO_2$ particle.
Figure 4:
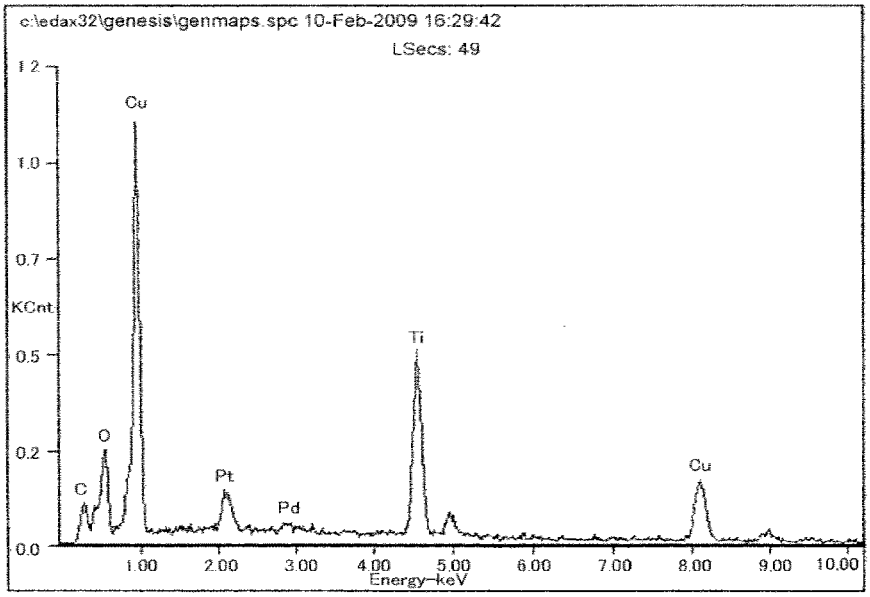
FIG. 4 is a graph showing a result of analysis of FIG. 3.
Figure 5:
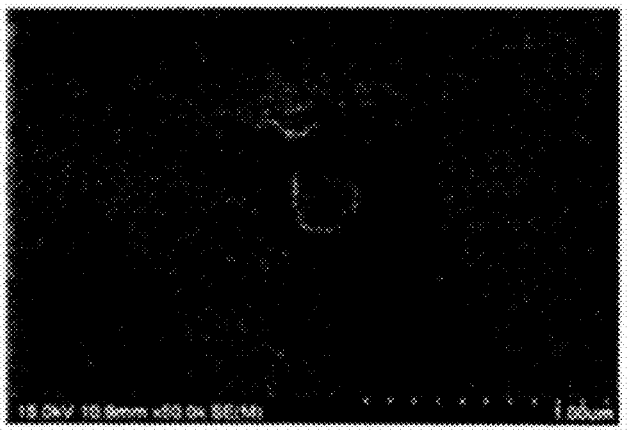
FIG. 5 is a SEM image showing a Ti—O—S particle of the present invention.
Figure 6:
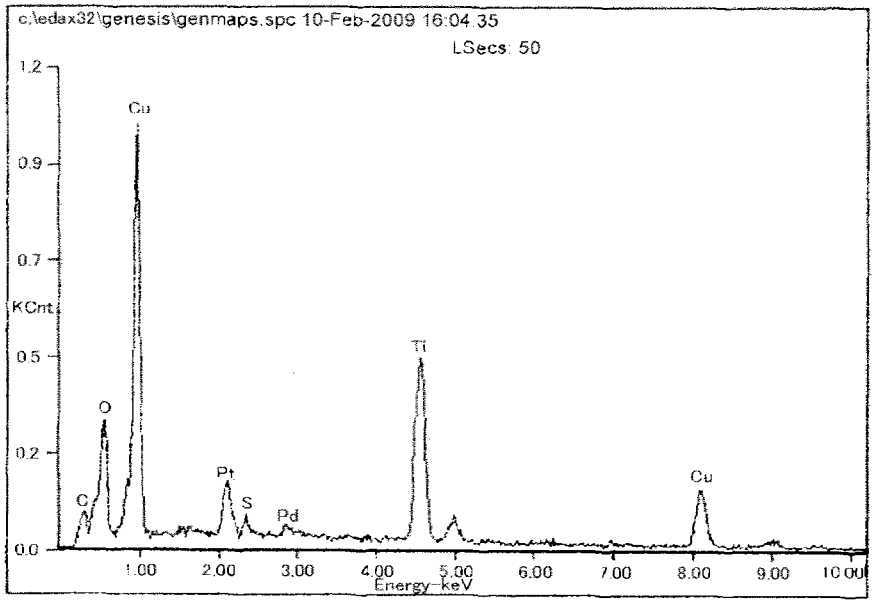
FIG. 6 is a graph showing a result of analysis of FIG. 5.

The oxygen (O) concentration in copper is increased to more than 2 mass ppm, and then, Ti is added thereto. It is considered that, as a result, the TiO, TiS, titanium oxide ($TiO_2$) or Ti—O—S particles are initially formed in molten copper (see the SEM images of FIGS. 1 and 3 and the results of analysis of FIGS. 2 and 4). It should be noted that Pt and Pd in FIGS. 2, 4 and 6 are vapor deposition elements used for the purpose of observation.

(b) Hot Rolling Temperature

Next, the hot rolling temperature is set to be lower (880 to 550° C.) than the temperature under the typical manufacturing conditions of copper (950 to 600° C.) so that dislocation is introduced into copper for easy precipitation of S. As a result, S is precipitated on the dislocation or is precipitated using titanium oxide ($TiO_2$) as a nucleus, and for example, TiO, TiS, $TiO_2$ or Ti—O—S particles, etc., are formed in the same manner as in the molten copper (see the SEM image of FIG. 5 and the result of analysis of FIG. 6). In other words, Ti is precipitated in a crystal grain or at crystal grain boundary of copper and is present in the form of any one of TiO, $TiO_2$, TiS and Ti—O—S. In FIGS. 1 to 6, a cross section of an 8 mm diameter copper wire (wire rod) having an oxygen (O) concentration, a sulfur (S) concentration and a titanium (Ti) concentration which are shown in the third row of Example 1 in Table 1 is evaluated by an SEM observation and an EDX analysis. The observation conditions are an acceleration voltage of 15 keV and an emission current of 10 μA.

The S in the Cu is crystallized and precipitated when satisfying the above (a) and (b), and it is thereby possible to provide a copper wire rod satisfying the softening temperature after the cold wire drawing process and the conductivity.

Manufacturing Conditions of Soft Dilute Copper Alloy Material

In the present embodiment, the following (1) to (3) are defined as conditions for manufacturing the soft dilute copper alloy material using the SCR continuous casting and rolling machine.

(1) Composition (a) Additional Elements

In the present embodiment, the reasons why Ti is selected as an additional element are as follows. Ti is likely to form a compound by binding to S in the molten copper. It is possible to process and easy to handle compared to other additional elements such as Zr, etc. It is cheaper than Nb, etc. It is likely to be precipitated using oxide as a nucleus.

Note that, the additional element to be added to pure copper may include at least one of Mg, Zr, Nb, Ca, V, N, Mn and Cr instead of Ti. The softening temperature of the soft dilute copper alloy material is 160 to 165° C. in the case of not adding Ti. This slight difference is caused by inevitable impurities which are not present in pure copper (6N).

The reason why element(s) selected from the group consisting of Mg, Zr, Nb, Ca, V, Ni, Mn, Ti and Cr is chosen as an additional element is as follows. The above-mentioned elements are active elements having a property prone to bind to other elements and thus are prone to bind to S, which allows S to be trapped and a copper base material (matrix) to be highly purified. One or more additional elements may be contained. In addition, other elements which do not adversely affect the properties of an alloy may be contained as an additional additive element in the alloy. Furthermore, impurities which do not adversely affect the properties of the alloy may be contained in the alloy.

(b) Oxygen (O) Content in Copper

The oxygen (O) content in copper is adjusted to more than 2 mass ppm since the softening temperature is less likely to decrease when the amount of oxygen (O) is low, as described above. On the other hand, since surface flaws are likely to be generated during the hot rolling process when the amount of oxygen (O) is too large, it is adjusted to not more than 30 mass ppm. In other words, so-called low-oxygen copper (LOC) is used in the present embodiment since ore than 2 mass ppm and not more than 30 mass ppm of O is contained.

As described above, it is preferable that the O content in copper be more than 2 and not more than 30 mass ppm. However, copper can contain more than 2 up to 400 mass ppm of O within a range providing the properties of the desired alloy, depending on the added amount of the additional element and the S content.

(c) Sulfur (S) Content

As described above, S is generally introduced into copper during the process of manufacturing electrolytic copper in the industrial production of pure copper. Therefore, it is difficult to adjust the S content to be not more than 3 mass ppm. On the other hand, the upper limit of the S concentration in general-purpose electrolytic copper is 12 mass ppm.

(d) Relation Between Content of Each Element and Conductivity

In order to obtain a soft copper material having a conductivity of not less than 98% IACS, a soft dilute copper alloy material in which pure copper with inevitable impurities (a base material) contains 3 to 12 mass ppm of S, more than 2 and not more than 30 mass ppm of O and 4 to 55 mass ppm of Ti is used to manufacture a wire rod (a roughly drawn wire).

In order to obtain a soft copper material having a conductivity of not less than 100% IACS, a wire rod is formed of a soft dilute copper alloy material containing pure copper with inevitable impurities, 2 to 12 mass ppm of S, more than 2 and not more than 30 mass ppm of O and 4 to 37 mass ppm of Ti.

In order to obtain a soft copper material having a conductivity of not less than 102% IACS, a wire rod is formed of a soft dilute copper alloy material containing pure copper with inevitable impurities, 3 to 12 mass ppm of S, more than 2 and not more than 30 mass ppm of O and 4 to 25 mass ppm of Ti.

(2) Dispersed Substance

Desirably, particles of a substance dispersed in a copper matrix (dispersed particles) are small in size and a large number of dispersed particles are distributed. It is because the dispersed particle functions as a precipitation site of S and it is thus required to be small in size and large in number.

Portions of S and Ti form a compound or an aggregate in the form of TiO, $TiO_2$, TiS or Ti—O—S. The remainders of S and Ti are present in the form of solid solution. In the soft dilute copper alloy material of the invention, TiO with a size of not more than 200 nm, $TiO_2$ with a size of not more than 1000 nm, TiS with a size of not more than 200 nm or Ti—O—S with a size of not more than 300 nm is distributed in the crystal grain.

As described above, the "crystal grain" means a crystalline structure of copper.

Note that, since the size of particle to be formed varies depending on holding time or a cooling status of the molten copper during the casting, it is also necessary to correspondingly determine casting conditions.

(3) Casting Conditions

A wire rod is manufactured by the SCR continuous casting and rolling where a compression ratio for processing an ingot rod is 90% (30 mm in diameter) to 99.8% (5 mm in diameter). As an example, a method of manufacturing an 8 mm diameter wire rod at a compression ratio of 99.3% is employed.

(a) Molten Copper Temperature in Melting Furnace

The molten copper temperature in a melting furnace is not less than 1100° C. and not more than 1320° C. The molten copper temperature is determined to be not more than 1320° C. since there is a tendency that a blow hole is increased, a flaw is generated and a particle size is enlarged when the temperature of the molten copper is high. On the other hand, the molten copper temperature is determined to be not less than 1100° C. since copper is likely to solidify and the manufacturing is not stable at the temperature lower than 1100° C. It should be noted that the casting temperature is desirably as low as possible within the above-mentioned range.

(b) Hot Rolling Temperature

The hot rolling temperature is not more than 880° C. at the initial roll and not less than 550° C. at the final roll.

Unlike the typical manufacturing conditions of pure copper, the subject of the invention is to crystallize S in the molten copper and to precipitate the S during the hot rolling. Therefore, it is preferable to limit the molten copper temperature and the hot rolling temperature as described in the above (a) and (b) in order to further decrease a solid solubility limit as an activation energy thereof.

The typical hot rolling temperature is not more than 950° C. at the initial roll and not less than 600° C. at the final roll, however, in order to further decrease the solid solubility limit, the temperature in the invention is determined to be not more than 880° C. at the initial roll and not less than 550° C. at the final roll.

After copper as a base material (copper base metal) is melted in a shaft furnace, a ladle is controlled to be a reduced-state. That is, a desirable method is that casting is carried out under reductive gas (CO) atmosphere while controlling concentrations of S, Ti and O, which are constituent elements of a dilute alloy, to stably manufacture a wire rod to be rolled. This is to prevent copper oxide from being mixed or the quality from declining due to the enlarged particle size.

Effects of the Present Embodiment

In the present embodiment, it is possible to obtain a soft dilute copper alloy wire or sheet material such that a wire rod with a diameter of 8 mm has a conductivity of not less than 98% IACS, not less than 100% IACS or further not less than 102% IACS, and a wire rod after the cold wire drawing process (e.g., 2.6 mm in diameter) has a softening temperature from 130° C. to 148° C.

As described above, the soft dilute copper alloy material of the invention can be used as a molten solder plating material (wire, plate, foil), an enameled wire, soft pure copper and high conductivity copper. Furthermore, it is possible to reduce energy at the time of annealing and it is possible to use as a soft copper wire. According to the invention, it is possible to obtain a useful soft dilute copper alloy material which has high productivity and is excellent in conductivity, softening temperature and surface quality.

Other Embodiments

In addition, a plating layer may be formed on a surface of the soft dilute copper alloy wire of the invention. A plating layer consisting mainly of, e.g., tin (Sn), nickel (Ni) or silver (Ag) is applicable, or, so-called Pb-free plating may be used therefor.

In addition, it is possible to form a soft dilute copper alloy stranded wire by twisting plural soft dilute copper alloy wires of the invention.

Furthermore, it is possible to form a cable by providing an insulation layer around the soft dilute copper alloy wire or soft dilute copper alloy stranded wire of the invention.

Also, it is possible to form a coaxial cable by twisting the plural soft dilute copper alloy wires of the invention to form a central conductor, forming an insulation covering on an outer periphery of the central conductor, arranging an outer conductor formed of copper or copper alloy on an outer periphery of the insulation covering and then providing a jacket layer on an outer periphery of the outer conductor.

In addition, it is possible to form a composite cable by arranging plural coaxial cables in a shield layer and then providing a sheath on an outer periphery of the shield layer.

The intended purpose of the soft dilute copper alloy wire of the invention includes use as, e.g., a wiring material for consumer solar cell, a motor enameled wire, a soft copper material for high-temperature application used at 200° C. to 700° C., a power cable conductor, a signal line conductor, a molten solder plating material which does not require annealing, a conductor for FPC wiring, a copper material excellent in thermal conductivity and an alternative material of high purity copper. The soft dilute copper alloy wire of the invention meets such a wide range of needs.

In addition, the shape of the soft dilute copper alloy wire of the invention is not specifically limited, and may be a conductor having a circular cross section, a rod-shaped conductor or a rectangular conductor.

Furthermore, the soft dilute copper alloy sheet of the invention is applicable to a wide range of applications such as a copper sheet used for a heatsink, a gauge copper strip used for a lead frame and copper foil used for a circuit board, etc.

Although an example in which a wire rod is made by the SCR continuous casting and rolling method and a soft material is made by the hot rolling has been described in the present embodiment, a twin-roll continuous casting and rolling method or a Properzi continuous casting and rolling method may be used for manufacturing in the invention.

EXAMPLES

Table 1 shows the measurement results of the semi-softening temperature, the conductivity and the dispersed particle size, where the conditions of the O concentration, the S concentration and the Ti concentration are varied.

TABLE 1

| Experimental material | Oxygen concentration (mass ppm) | S concentration (mass ppm) | Ti concentration (mass ppm) | 2.6 mm diameter semi-softening temperature (° C.) | 2.6 mm diameter conductivity of soft material (% IACS) | Evaluation of dispersed particle size | Overall evaluation |
|---|---|---|---|---|---|---|---|
| Comparative Material 1 | 1 to less than 2 | 5 | 0 | 215 X | 101.7 | ○ | X |
| (small continuous | 1 to less than 2 | 5 | 7 | 168 X | 101.5 | ○ | X |
| casting machine) | 1 to less than 2 | 5 | 13 | 160 X | 100.9 | ○ | X |
| | 1 to less than 2 | 5 | 15 | 173 X | 100.5 | ○ | X |
| | 1 to less than 2 | 5 | 18 | 190 X | 99.6 | ○ | X |
| Comparative Material 2 | 7 to 8 | 3 | 0 | 164 X | 102.2 | ○ | X |
| (SCR) | 7 to 8 | 5 | 2 | 157 X | 102.1 | ○ | X |
| Example Material 1 | 7 to 8 | 5 | 4 | 148 ○ | 102.1 | ○ | ○ |
| (SCR) | 7 to 8 | 5 | 10 | 135 ○ | 102.2 | ○ | ○ |
| | 7 to 8 | 5 | 13 | 134 ○ | 102.4 | ○ | ○ |
| | 7 to 8 | 5 | 20 | 130 ○ | 102.2 | ○ | ○ |
| | 7 to 8 | 5 | 25 | 132 ○ | 102.0 | ○ | ○ |
| | 7 to 8 | 5 | 37 | 134 ○ | 101.1 | ○ | ○ |
| | 7 to 8 | 5 | 40 | 135 ○ | 99.6 | ○ | ○ |
| | 7 to 8 | 5 | 55 | 148 ○ | 98.2 | ○ | ○ |
| Comparative Material 3 | 7 to 8 | 5 | 60 | 155 X | 97.7 | X | X |
| (SCR) | | | | | | poor surface quality | |
| Example Material 2 | difficult to control stability at less than 2 | 5 | 13 | 145 ○ | 102.1 | ○ | Δ |
| (SCR) | more than 2 but not more than 3 | 5 | 11 | 133 ○ | 102.2 | ○ | ○ |
| | 3 | 5 | 12 | 133 ○ | 102.2 | ○ | ○ |
| | 30 | 5 | 10 | 134 ○ | 102.0 | ○ | ○ |
| Comparative Material 4 | 40 | 5 | 14 | 134 ○ | 101.8 | X | X |
| (SCR) | | | | | | poor surface quality | |
| Example Material 3 | 7 to 8 | 2 | 4 | 134 ○ | 102.2 | ○ | ○ |
| (SCR) | 7 to 8 | 10 | 13 | 135 ○ | 102.3 | ○ | ○ |
| | 7 to 8 | 12 | 14 | 136 ○ | 102.2 | ○ | ○ |
| | 7 to 8 | 11 | 19 | 133 ○ | 102.4 | ○ | ○ |
| | 7 to 8 | 12 | 20 | 133 ○ | 102.4 | ○ | ○ |
| Comparative Material 5 | 7 to 8 | 18 | 13 | 162 X | 101.5 | ○ | X |
| Comparative Material 6 (Cu (6N)) | | | | 127 to 130 ○ | 102.8 | none | — |

Firstly, 8 mm diameter copper wires (wire rods) having concentrations of oxygen (O), sulfur (S) and titanium (Ti) shown in Table 1 were respectively made as experimental materials (at a compression ratio of 99.3%). The 8 mm diameter copper wire has been hot rolled by SCR continuous casting and rolling. Copper molten metal which was melted in a shaft furnace was poured into a ladle under a reductive gas atmosphere, the molten copper poured into the ladle was introduced into a casting pot under the same reductive gas atmosphere, and Ti was added to the molten copper in the casting pot. After that, the resulting molten copper was introduced through a nozzle into a casting mold formed between a casting wheel and an endless belt, thereby making an ingot rod. The 8 mm diameter copper wire was made by hot rolling the ingot rod. The experimental materials were cold-drawn, and then, the semi-softening temperature and the conductivity of the 2.6 mm diameter wire rod were measured, and also the dispersed particle size in the 8 mm diameter copper wire was evaluated.

The oxygen (O) concentration was measured by an oxygen analyzer (Leco Oxygen Analyzer manufactured by LECO Japan Corporation (Leco: registered trademark)). Each concentration of S and Ti was analyzed by an ICP emission spectrophotometer (Inductively Coupled Plasma Atomic Emission Spectroscope: ICP-AES).

After holding for one hour at each temperature of not more than 400° C., water quenching and a tensile test were carried out to measure the semi-softening temperature of the 2.6 mm diameter wire rod. After obtaining the result of the tensile test at a room temperature and the result of the tensile test of the soft copper wire which was heat-treated in an oil bath at 400° C. for one hour, the tensile strengths of the two tensile tests were added and then divided by two, and the temperature corresponding to strength indicated by the resulting value was defined as a "semi-softening temperature".

It is desirable that the dispersed particles be small in size and a large number of dispersed particles be distributed. This is because the dispersed particle is required to be small in size and large in number in order to function as a precipitation site of S. Accordingly, it is judged as "Passed the test" when not less than 90% of dispersed particles have a size of not more than 500 nm. As described above, "size" in the table is a size of a compound and means a size of a long diameter of the compound in a shape having long and short diameters. Meanwhile, "particle" indicates the TiO, $TiO_2$, TiS or Ti—O—S. In addition, "90%", etc., indicates a ratio of the number of such particles to the total number of particles.

Comparative Material 1

In Table 1, Comparative Material 1 is a sample of a copper wire having a diameter of 8 mm which was formed under Ar atmosphere and in which 0 to 18 mass ppm of Ti was added to the copper molten metal.

When focused on the Ti concentration, while the semi-softening temperature was 215° C. at the Ti concentration of zero, the semi-softening temperature was lowered to the minimum temperature of 160° C. at the Ti concentration of 13 mass ppm. On the other hand, the semi-softening temperature was high at the Ti concentrations of 15 mass ppm and 18 mass ppm and the desired softening temperature of not more than 148° C. was not obtained. Although the industrially demanded conductivity of not less than 98% IACS was satisfied, the overall evaluation was "× (Failed)".

Next, an 8 mm diameter copper wire (wire rod) was experimentally formed by the SCR continuous casting and rolling method while adjusting the O concentration to be 7 to 8 mass ppm.

Comparative Material 2

Among the copper wires experimentally formed by the SCR continuous casting and rolling method, Comparative Material 2 has the low Ti concentration (0 and 2 mass ppm) and the conductivity thereof was not less than 102% IACS. However, the semi-softening temperatures were respectively 164° C. and 157° C. which does not satisfy the desired temperature of not more than 148° C., hence, the overall evaluation was "×".

Example Material 1

Samples of Example Material 1 have the substantially constant O and S concentrations (7 to 8 mass ppm and 5 mass ppm, respectively) and different Ti concentrations (4 to 55 mass ppm).

The Ti concentration range of 4 to 55 mass ppm is satisfactory because the softening temperature is not more than 148° C. the conductivity is not less than 98% IACS or not less than 102% IACS and the dispersed particle size is not more than 500 μm in not less than 90% of particles. In addition, the surface of the wire rod is also fine and all samples satisfy the product performances thereof (the overall evaluation is "○ (Passed)").

Here, the conductivity of not less than 100% IACS is satisfied at the Ti concentration of 4 to 37 mass ppm and not less than 102% IACS is satisfied at the Ti concentration of 4 to 25 mass ppm. The conductivity of 102.4% IACS which is the maximum value was exhibited at the Ti concentration of 13 mass ppm, and the conductivity at around this concentration was a slightly lower value. It is considered that this is because, when the Ti is 13 mass ppm, sulfur (S) in copper is trapped as a compound, and thus, the conductivity close to that of high purity copper (6N) is exhibited.

Therefore, it is possible to satisfy both of the semi-softening temperature and the conductivity by increasing the O concentration and adding Ti.

Comparative Material 3

Comparative Material 3 are samples in which the Ti concentration is increased to 60 mass ppm. Comparative Material 3 satisfies the desired conductivity, however, the semi-softening temperature is not less than 148° C., which does not satisfy the product performance. Furthermore, there were many surface flaws on the wire rod, hence, it was difficult to treat as a commercial product. Therefore, the preferable added amount of Ti is less than 60 mass ppm.

Example Material 2

Samples of Example Material 2 have an S concentration of 5 mass ppm, a Ti concentration of 13 to 10 mass ppm and various O concentrations to examine the affect of the oxygen concentration.

Samples having largely different O concentrations from more than 2 mass ppm to not more than 30 mass ppm were prepared. Since it is difficult to produce and the stable manufacturing is not possible when the O concentration is not more than 2 mass ppm, the overall evaluation is Δ (not good). In addition, it was found that the semi-softening temperature and the conductivity are both satisfied even when the O concentration is increased to 30 mass ppm.

Comparative Material 4

As shown in Comparative Material 4, there were many flaws on the surface of the wire rod at the O concentration of 40 mass ppm and it was in a condition which cannot be a commercial product.

Accordingly, the O concentration was adjusted to be in a range of more than 2 and not more than 30 mass ppm, and it was thus possible to satisfy all characteristics of the semi-softening temperature, the conductivity of not less than 102% IACS and the dispersed particle size. In addition, the surface of the wire rod is fine and all samples can satisfy the product performance.

Example Material 3

As for Example Material 3, each sample has an O concentration relatively close to a Ti concentration and an S concentration varied from 4 to 20 mass ppm. In Example Material 3, it was not possible to realize to obtain a sample having the S concentration of less than 2 mass ppm due to the raw material thereof. However, it is possible to satisfy both the semi-softening temperature and the conductivity by controlling the concentrations of Ti and S.

Comparative Material 5

Comparative Material 5, in which the S concentration is 18 mass ppm and the Ti concentration is 13 mass ppm, has a high semi-softening temperature of 162° C. and could not satisfy requisite characteristics. In addition, the surface quality of the wire rod is specifically poor, and it was thus difficult to commercialize.

As described above, it was found that, when the S concentration is 2 to 12 mass ppm, all characteristics which are the semi-softening temperature, not less than 102% IACS of conductivity and the dispersed particle size are satisfied, the surface of the wire rod is also fine and all product performances are satisfied.

Comparative Material 6

When high purity copper (6N) was used as Comparative Material 6, the semi-softening temperature was 127 to 130° C., the conductivity was 102.8% IACS and the particles having the dispersed particle size of not more than 500 μm were not observed at all.

Table 2 shows the results of measurement where the molten copper temperature and the hot rolling temperature as the manufacturing conditions were varied.

Comparative Material 7

Comparative Material 7 is an 8 mm diameter wire rod experimentally formed at the slightly high molten copper temperature of 1330 to 1350° C. and at the rolling temperature of 950 to 600° C. Although Comparative Material 7 satisfies the desired semi-softening temperature and the conductivity, there are particles having a dispersed particle size of about 1000 nm and more than 10% of particles were not less than 500 nm. Therefore, it is judged as inapplicable.

Example Material 4

Example Material 4 is an 8 mm diameter wire rod experimentally formed at the molten copper temperature of 1200 to 1320° C. and at the slightly low rolling temperature of 880 to 550° C. Example Material 4 was satisfactory in the surface quality of wire and the dispersed particle size, and the overall evaluation was "○".

Comparative Material 8

Comparative Material 8 is an 8 mm diameter wire rod experimentally formed at the molten copper temperature of 1100° C. and at the slightly low rolling temperature of 880 to 550° C. Comparative Material 8 was not suitable as a commercial product since there were many surface flaws on the wire rod due to the low molten copper temperature. This is because the flaws are likely to be generated at the time of rolling since the molten copper temperature is low.

Comparative Material 9

Comparative Material 9 is an 8 mm diameter wire rod experimentally formed at the molten copper temperature of 1300° C. and at the slightly high rolling temperature of 950 to 600° C. The wire rod in Comparative Material 9 had satisfactory surface quality since the hot rolling temperature is high. However, the large dispersed particles are present and the overall evaluation is "×".

Comparative Material 10

Comparative Material 10 is an 8 mm diameter wire rod experimentally formed at the molten copper temperature of 1350° C. and at the slightly low rolling temperature of 880 to 550° C. In Comparative Material 10, the large dispersed particles are present since the molten copper temperature is high, and the overall evaluation is "×".

TABLE 2

| Experimental material | Molten copper temperature (° C.) | Oxygen concentration (mass ppm) | S concentration (mass ppm) | Ti concentration (mass ppm) | Hot-rolling temperature (° C.) Initial-Final | 2.6 mm diameter semi-softening temperature (° C.) | 2.6 mm diameter conductivity of soft material (% IACS) | WR surface quality | Evaluation of dispersed particle size | Overall evaluation |
|---|---|---|---|---|---|---|---|---|---|---|
| Comparative | 1350 | 15 | 7 | 13 | 950-600 | 148 | 101.7 | X | X | X |
| Material 7 | 1330 | 16 | 6 | 11 | 950-600 | 147 | 101.2 | X | X | X |
| Example | 1320 | 15 | 5 | 13 | 880-550 | 143 | 102.1 | ○ | ○ | ○ |
| Material 4 | 1300 | 16 | 6 | 13 | 880-550 | 141 | 102.3 | ○ | ○ | ○ |
| | 1250 | 15 | 6 | 14 | 880-550 | 138 | 102.1 | ○ | ○ | ○ |
| | 1200 | 15 | 6 | 14 | 880-550 | 135 | 102.1 | ○ | ○ | ○ |
| Comparative Material 8 | 1100 | 12 | 5 | 12 | 880-550 | 135 | 102.1 | X | ○ | X |
| Comparative Material 9 | 1300 | 13 | 6 | 13 | 950-600 | 147 | 101.5 | ○ | X | X |
| Comparative Material 10 | 1350 | 14 | 6 | 12 | 880-550 | 149 | 101.5 | X | X | X |

Softening Characteristics of Soft Dilute Copper Alloy Wire

Table 3 shows the results of examining Vickers hardness (Hv) using samples of Comparative Material 11 and Example Material 5 which were annealed at different annealing temperatures for 1 hour. The samples having a diameter of 2.6 mm were used.

Comparative Material 11

An oxygen-free copper wire was used as Comparative Material 11.

Example Material 5

Example Material 5 is a soft dilute copper alloy wire which contains low-oxygen copper and 13 mass ppm of Ti and has the same alloy composition as that described in Example Material 1 of Table 1.

Table 3 shows that Vickers hardness (Hv) of Comparative Material 11 is at the equivalent level to that of Example Material 5 at the annealing temperature of 400° C., as well as at the annealing temperature of 600° C. This shows that the soft dilute copper alloy wire of the invention has sufficient softening characteristics and is especially excellent in softening characteristics at the annealing temperature of more than 400° C. even in comparison to an oxygen-free copper wire.

TABLE 3

| | 20° C. | 400° C. | 600° C. |
|---|---|---|---|
| Example Material 5 | 120 | 52 | 48 |
| Comparative Material 11 | 124 | 53 | 56 |

(Unit: Hv)

Examination of Proof Stress and Bending Life of Soft Dilute Copper Alloy Wire

Table 4 shows the result of examining variation in a 0.2% proof stress value using samples of Comparative Material 12 and Example Material 6 after annealing at different annealing temperatures for 1 hour. The samples having a diameter of 2.6 mm were used.

Comparative Material 12

An oxygen-free copper wire was used as Comparative Material 12.

Example Material 6

A soft dilute copper alloy wire containing low-oxygen copper and 13 mass ppm of Ti was used as Example Material 6.

Table 4 shows that the 0.2% proof stress value of Comparative Material 12 and that of Example Material 6 are at the equivalent level at the annealing temperature of 400° C., and are nearly the same at the annealing temperature of 600° C.

TABLE 4

| | 20° C. | 250° C. | 400° C. | 600° C. | 700° C. |
|---|---|---|---|---|---|
| Example Material 6 | 421 | 80 | 58 | 35 | 25 |
| Comparative Material 12 | 412 | 73 | 53 | 32 | 24 |

(Unit: MPa)

Figure 8:
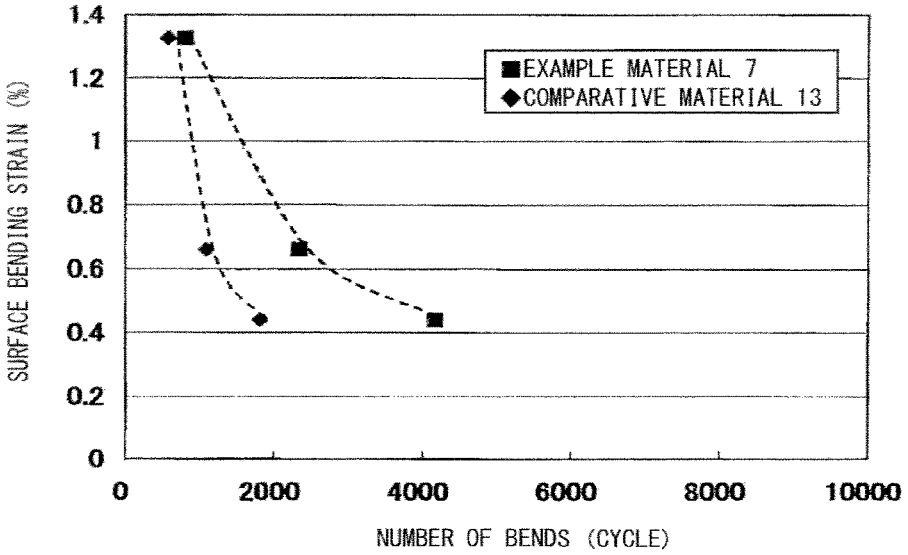
FIG. 8 is a graph showing bending lives of Comparative Material 13 using an oxygen-free copper wire and Example Material 7 using a soft dilute copper alloy wire made of low-oxygen copper with Ti added thereto, which are measured after annealing treatment at 400° C. for 1 hour.

The soft dilute copper alloy wire of the invention is required to have a long bending life. FIG. 8 shows the measurement results of the bending life of Comparative Material 13 and that of Example Material 7. The samples used here are a 0.26 mm diameter wire rod annealed at the annealing temperature of 400° C. for 1 hour.

Comparative Material 13

An oxygen-free copper wire was used as Comparative Material 13. Comparative Material 13 has the same element composition as that of Comparative Material 11.

Example Material 7

A soft dilute copper alloy wire formed of low-oxygen copper with Ti added thereto was used as Example Material 7. Example Material 7 also has the same element composition as that of Example Material 5.

Bending Fatigue Test

Figure 7:
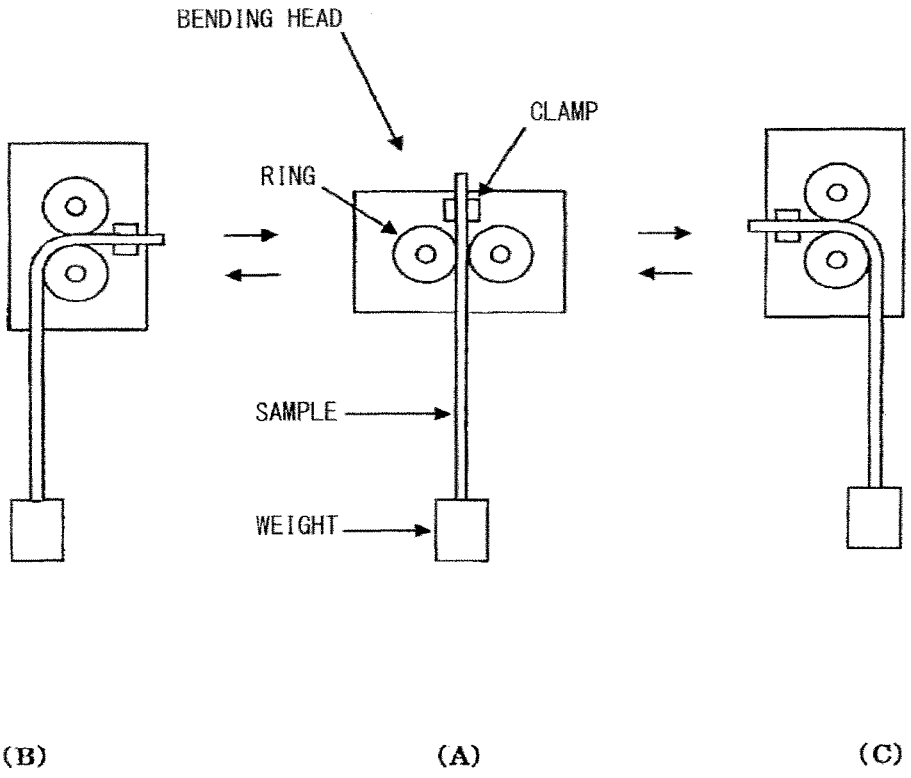
FIG. 7 is a schematic view showing a bending fatigue test.

A bending fatigue test was conducted to measure the bending life. The bending fatigue test is a test in which a load is applied to a sample to impart tension and compression strain to the surface thereof by cyclic bending. The method of conducting the bending fatigue test is shown in FIG. 7. The sample is placed between bending jigs (which are referred to as "ring" in the drawing) as shown in (A) and is bent by a 90° rotation of the jigs as shown in (B) while the load is still applied. This operation generates a compressive strain on a surface of the wire rod in contact with the bending jig and a tensile strain on an opposite surface. After that, it returns to a state (A) again. Then, the sample is bent by a 90° rotation in a direction opposite to the direction shown in (B). This also generates a compressive strain on the surface of the wire rod in contact with the bending jig and a tensile strain on the opposite surface, and it becomes a state (C). Then, it returns to the initial state (A) from (C). One bending fatigue cycle consisting of (A)-(B)-(A)-(C)-(A) requires 4 seconds.

Here, the surface bending strain can be derived by the following formula.

$$\text{Surface bending strain } (\%) = r/(R+r) \times 100\ (\%)$$

R: bending radius of wire, r: radius of wire

The test data of FIG. 8 shows that the bending life of Example Material 7 of the invention is longer than that of Comparative Material 13.

Figure 9:
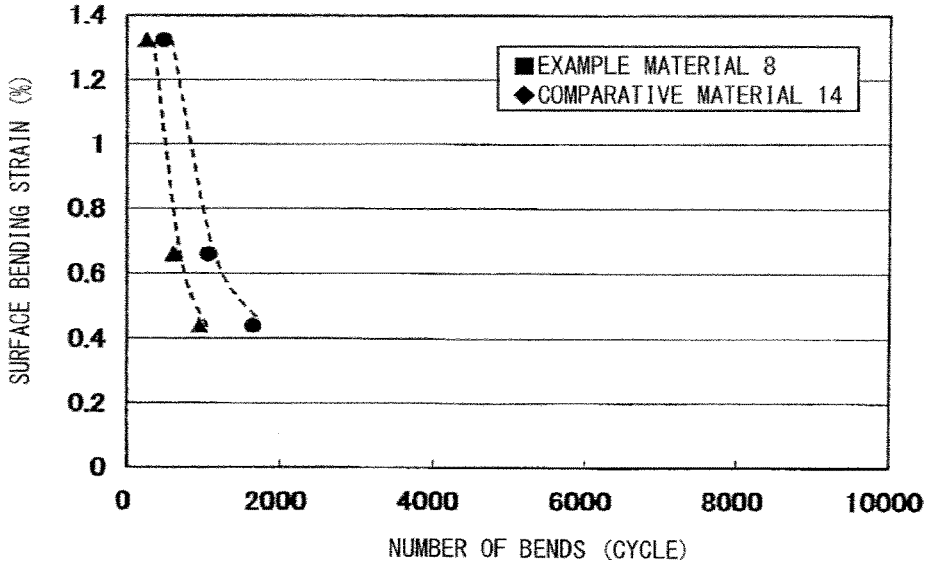
FIG. 9 is a graph showing bending lives of Comparative Material 14 using an oxygen-free copper wire and Example Material 8 using a soft dilute copper alloy wire made of low-oxygen copper with Ti added thereto, which are measured after annealing treatment at 600° C. for 1 hour.

Next, the results of measuring the bending lives of Comparative Material 14 and Example Material 8 are shown in FIG. 9. The samples used here are a 0.26 mm diameter wire rod annealed at the annealing temperature of 600° C. for 1 hour.

Comparative Material 14

An oxygen-free copper wire was used as Comparative Material 14. Comparative Material 13 has the same element composition as that of Comparative Material 11.

Example Material 8

A soft dilute copper alloy wire formed of low-oxygen copper with Ti added thereto was used as Example Material 8. Example Material 7 also has the same element composition as that of Example Material 5.

The bending life was measured under the same conditions as the measuring method shown in FIG. 8. Also in this case, Example Material 8 of the invention exhibits the longer bending life than Comparative Material 14. It is understood that this is resulted from that the Example Materials 7 and 8 exhibit a greater 0.2% proof stress value than Comparative Materials 13 and 14 under any annealing conditions.

Examination of Crystalline Structure of Soft Dilute Copper Alloy Wire

Figure 10:
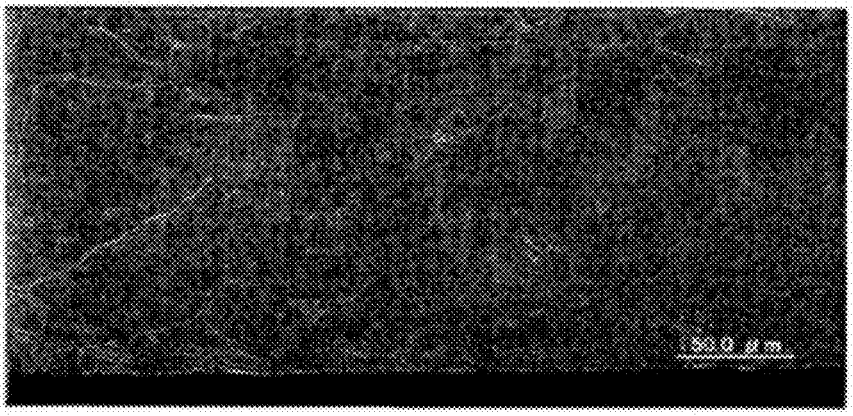
FIG. 10 is a photograph showing a cross section structure across-the-width of Example Material 8.
Figure 11:
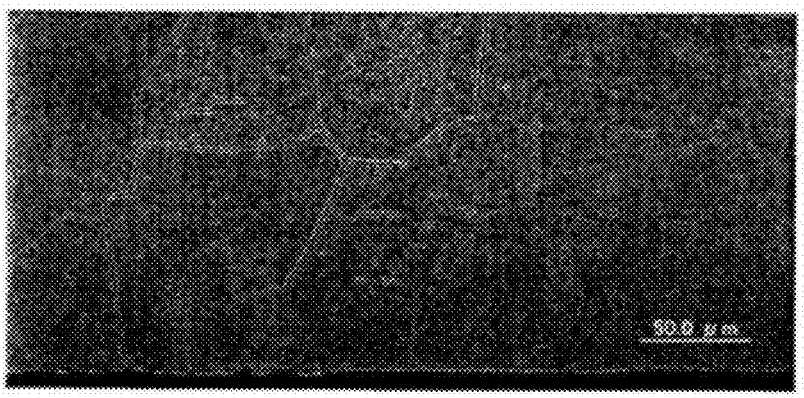
FIG. 11 is a photograph showing a cross section structure across-the-width of a sample of Comparative Material 14.

FIG. 10 is a photograph showing across section structure across-the-width of a sample of Example Material 8 and FIG. 11 is a photograph showing a cross section structure across-the-width of Comparative Material 14. FIG. 11 shows a crystalline structure of Comparative Material 14 and FIG. 10 shows a crystalline structure of Example Material 8.

Referring to FIGS. 10 and 11, it is understood that crystal grains having an equal size all around are uniformly aligned from the surface to the middle portion in the crystalline structure of Comparative Material 14 and, in contrast, the size of crystal grain in the crystalline structure of Example Material 8 is uneven (non-uniform) as a whole. It is notable here that a crystal grain size in a thin layer formed on the sample near a surface thereof in a cross-sectional direction is extremely smaller than that of an inner portion. In other words, there is formed a recrystallized structure having a grain size distribution in which the crystal gain of the inner portion is large and that in the surface layer is small.

The inventors consider that a fine crystal grain layer appeared as a surface layer, which is not formed in Comparative Material 14, contributes to improve bending characteristics of Example Material 8.

In general, it is understood that uniformly coarsened crystal grains are formed by recrystallization as is in Comparative Material 14 if annealing treatment is carried out at an annealing temperature of 600° C. for 1 hour. However, a fine crystal grain layer remains as a surface layer in the invention even after the annealing treatment at the annealing temperature of 600° C. for 1 hour, hence, a soft dilute copper alloy material with satisfactory bending characteristics is obtained even though it is a soft copper material.

Figure 12:
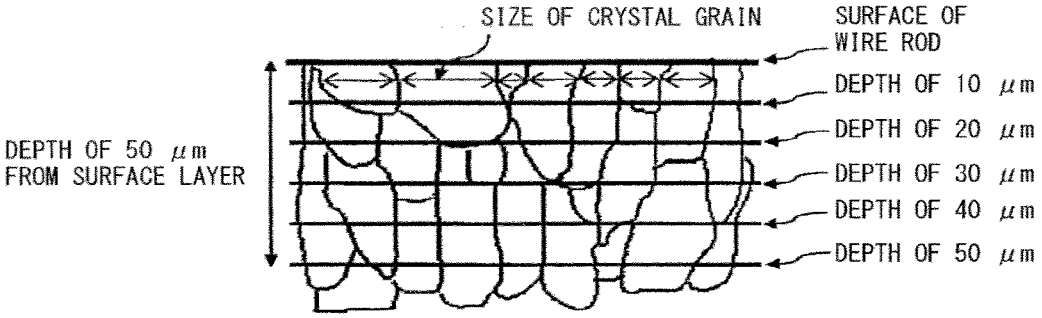
FIG. 12 is an explanatory diagram illustrating a method of measuring an average crystal grain size in a surface layer of a sample.

Furthermore, average crystal grain sizes in the surface layers of the samples of Example Material 8 and Comparative Material 14 were measured based on the cross-sectional images of the crystalline structures shown in FIGS. 10 and 11. Here, for measuring an average crystal grain size in the surface layer, a crystal grain size was measured within 1 mm in length from a surface of a widthwise cross section of a 0.26 mm diameter wire rod up to a depth of 50 μm at intervals of 10 μm in a depth direction as shown in FIG. 12, and an average of the actual measured values was defined as an average crystal grain size in the surface layer.

As a result of the measurement, the average crystal grain size, 50 μm, in the surface layer of Comparative Material 14 is significantly different from that, 10 μm, of Example Material 8. It is assumed that a fine average crystal grain size in the surface layer causes suppression in development of cracks by the bending fatigue test. whereby the bending fatigue life has been elongated (Note that, cracks are likely to develop along a crystal grain boundary when the crystal grain size is large. However, the development of cracks may be suppressed since the development direction of cracks is easily changed when the crystal grain size is so small). Thus, it is assumed that this causes the significant difference in the bending characteristics between Comparative Materials and Example Materials as described above.

Meanwhile, average crystal grain sizes in the surface layers of Example Material 6 and Comparative Material 12 each having a diameter of 2.6 mm were obtained by measuring crystal grain sizes within 10 mm in length from the surface of a widthwise cross section of a 2.6 mm diameter wire rod up to a depth of 50 μm in a depth direction.

As a result of the measurement, the average crystal grain size in the surface layer of Comparative Material 12 was 100 μm and that of Example Material 6 was 20 μm.

In order to achieve the effects of the invention, the upper limit of the average crystal grain size in the surface layer from the surface up to a depth of 50 μm is preferably not more than 20 μm, and considering a limit value for production, the lower limit is supposed to be not less than 5 μm.

Examination of Crystalline Structure of Soft Dilute Copper Alloy Material

Figure 13:
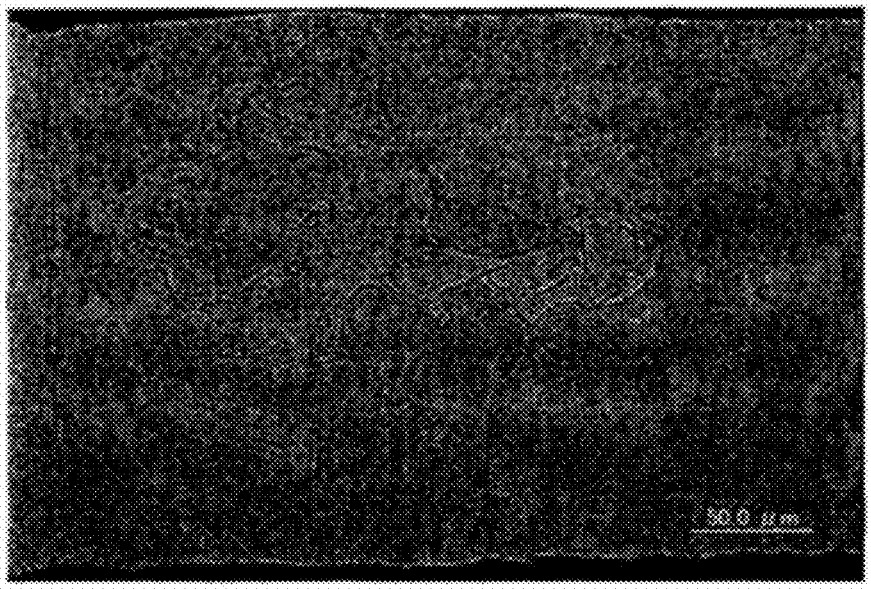
FIG. 13 is a photograph showing a cross section structure across-the-width of Example Material 9.
Figure 14:
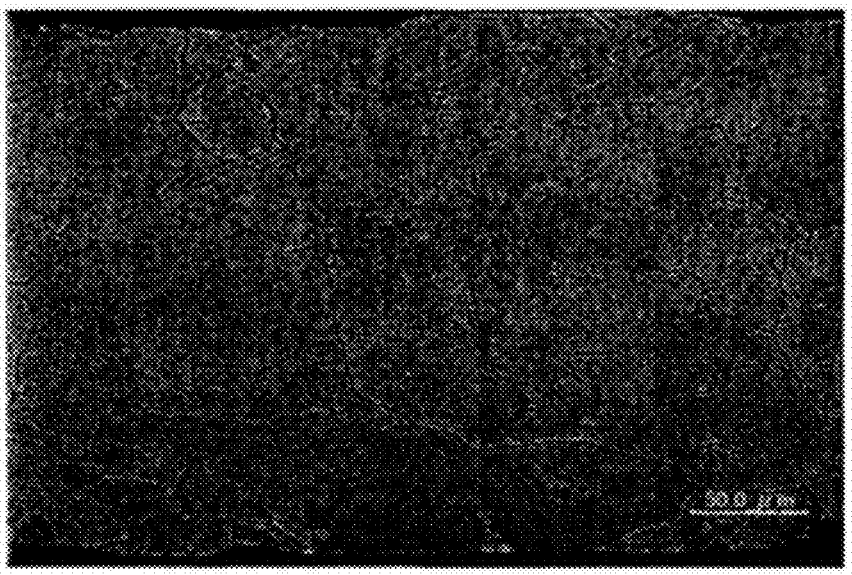
FIG. 14 is a photograph showing a cross section structure across-the-width of a sample of Comparative Material 15.

FIG. 13 is a photograph showing a cross section structure across-the-width of a sample of Example Material 9 and FIG. 14 is a photograph showing a cross section structure across-the-width of Comparative Material 15. FIG. 13 shows a crystalline structure of Example Material 9 and FIG. 14 shows a crystalline structure of Comparative Material 15.

Example Material 9

Example Material 9 is a 0.26 mm diameter wire rod having the highest soft material conductivity shown in the third row of Example Material 1 in Table 1. Example Material 9 is made through annealing treatment at an annealing temperature of 400° C. for 1 hour.

Comparative Material 15

Comparative Material 15 is a 0.26 mm diameter wire rod formed of oxygen-free copper (OFC). Comparative Material 15 is made through annealing treatment at an annealing temperature of 400° C. for 1 hour. Conductivity of Example Material 9 and Comparative Material 15 are shown in Table 5.

TABLE 5

| | Conductivity of soft material (% IACS) |
|---|---|
| Example Material 9 | 102.4 |
| Comparative Material 15 | 101.8 |

As shown in FIGS. 13 and 14, it is understood that crystal grains having an equal size all around are uniformly aligned from the surface to the middle portion in the crystalline structure of Comparative Material 15. In contrast, the crystalline structure of Example Material 9 has a difference in the size of crystal grain between the surface layer and the inner portion, forming a recrystallized structure in which a crystal grain size of the inner portion is extremely larger than that in the surface layer.

In Example Material 9, S in copper of a conductor which is processed to have a diameter of, e.g., 2.6 mm in diameter or 0.26 mm in diameter is trapped in the form of Ti-S or Ti—O—S. In addition, oxygen (O) included in copper is present in the form of $Ti_xO_y$, e.g., $TiO_2$, and is precipitated in a crystal grain or at crystal grain boundary.

Therefore, in Example Material 9, recrystallization is likely to proceed when copper is annealed to recrystallize the crystalline structure, and thus, the crystal grains of the inner portion grow to be large. Accordingly, when passing an electric current through Example Material 9, electron flow is less disturbed as compared to Comparative Material 15, hence, electrical resistance decreases. Therefore, the conductivity (% IACS) of Example Material 9 is greater than that of Comparative Material 15.

As a result, a product using Example Material 9 is soft and can have an improved conductivity and improved bending characteristics. A conventional conductor requires high temperature annealing treatment in order to recrystallize the crystalline structure to have a size equivalent to that in Example Material 9. However, S is re-dissolved when the annealing temperature is too high. In addition, there is a problem that the conventional conductor is softened when recrystallized and the bending characteristics decreases. Example Material 9 has a feature that, while crystal grains of the inner portion become large and the material becomes soft since it can be recrystallized without twining at the time of annealing, the bending characteristics do not decrease since fine crystals remain in the surface layer.

Figure 15:
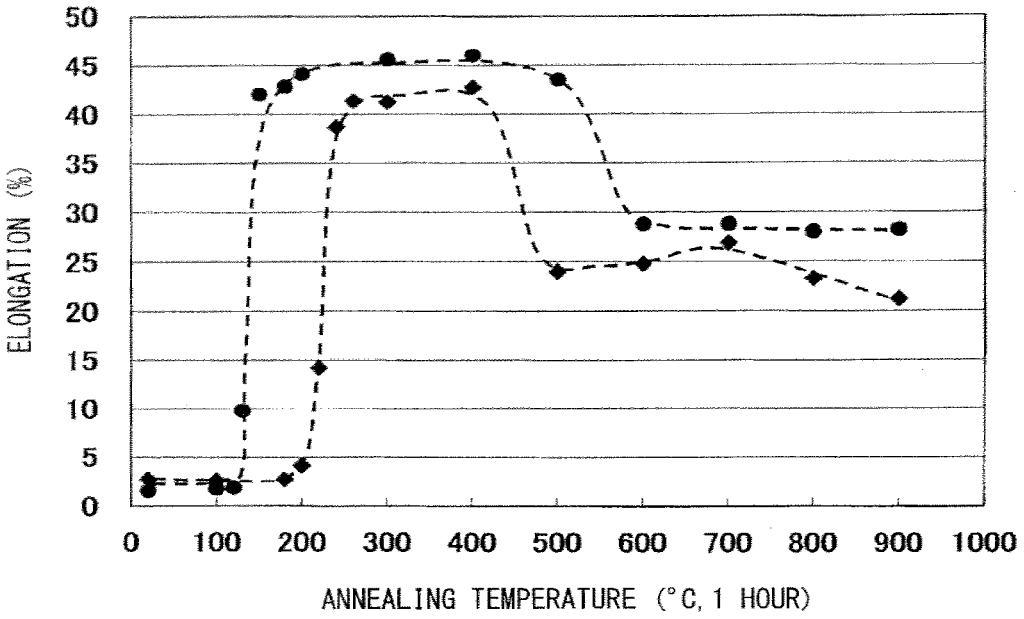
FIG. 15 is a graph showing a relation between an annealing temperature and elongation (%) of Example Material 9 and Comparative Material 15.

Relation Between Elongation Characteristics and Crystalline Structure of Soft Dilute Copper Alloy Wire FIG. 15 is a graph for verifying variation in elongation (%) using samples of Comparative Material 15 and Example Material 9 after annealing at different annealing temperatures for 1 hour.

Comparative Material 15

A 2.6 mm diameter oxygen-free copper wire was used as Comparative Material 15.

Example Material 9

A 2.6 mm diameter soft dilute copper alloy wire containing low-oxygen copper and 13 mass ppm of Ti was used as Example Material 9.

In FIG. 15, a circle point indicates Example Material 9 and a square point indicates Comparative Material 15. FIG. 15 shows that Example Material 9 exhibits better elongation characteristics than Comparative Material 15 at an annealing temperature of more than 100° C. in a wide range of around 130° C. to 900° C.

Figure 16:
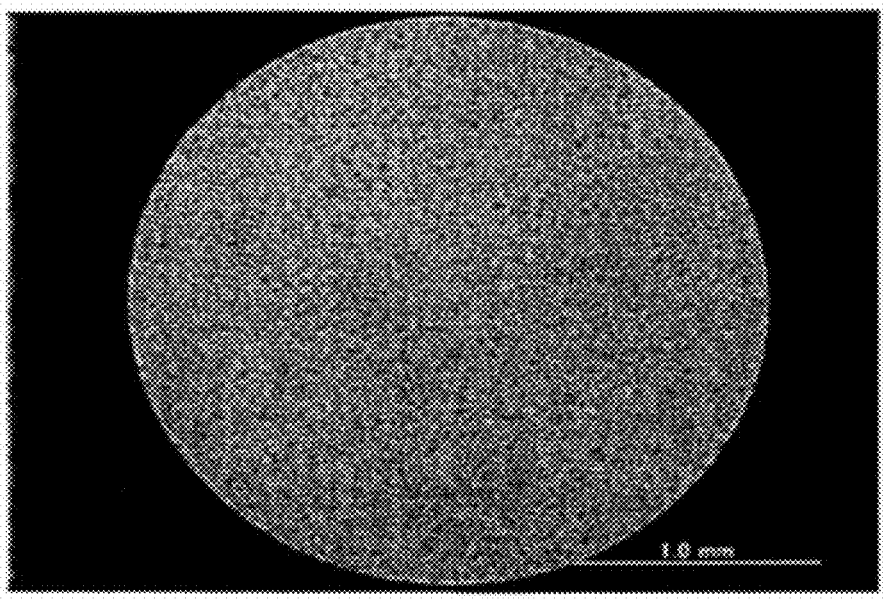
FIG. 16 is a photograph showing a cross section of Example Material 9 annealed at a temperature of 500° C.

FIG. 16 is a photograph showing a cross section of a copper wire of Example Material 9 annealed at a temperature of 500° C. Referring FIG. 16, a fine crystalline structure is formed on the entire cross section of the copper wire and it appears that the fine crystalline structure contributes to the elongation characteristics. On the other hand, secondary recrystallization has proceeded in the cross section structure of Comparative Material 15 at the annealing temperature of 500° C., and crystal grains in the cross section structure were coarsened as compared to the crystalline structure of FIG. 16. It is considered that this decreases the elongation characteristics.

Figure 17:
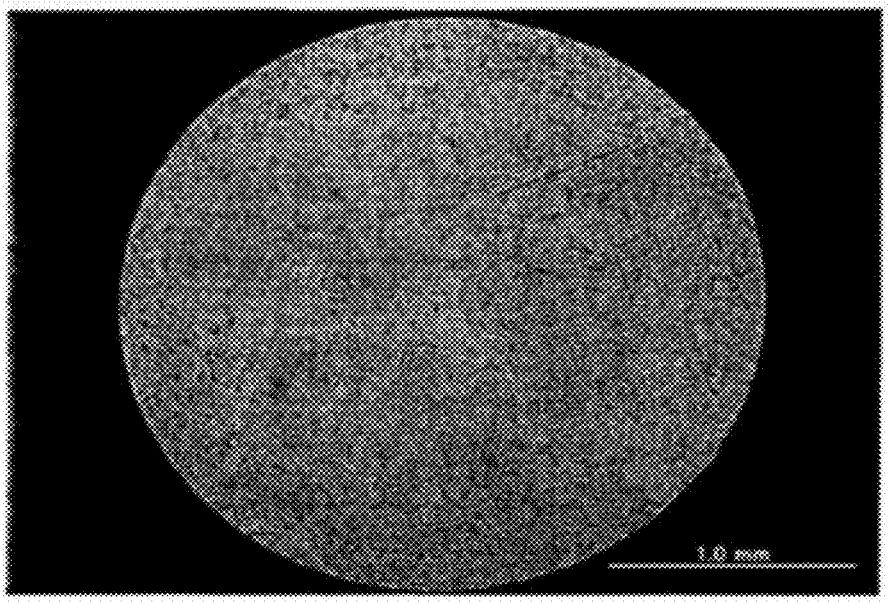
FIG. 17 is a photograph showing a cross section of Example Material 9 annealed at a temperature of 700° C.

FIG. 17 is a photograph showing a cross section of a copper wire of Example Material 9 annealed at a temperature of 700° C. Referring FIG. 17, it is found that the crystal grain size in the surface layer on the cross section of the copper wire is extremely smaller than the crystal grain size of the inner portion. In Example Material 9, although secondary recrystallization has proceeded in the crystalline structure of the inner portion, a fine crystal grain layer remains as the outer layer. It is considered that the elongation characteristics are maintained in Example Material 9 since the fine crystal layer remains as the surface layer even though the crystalline structure of the inner portion grows to be large.

Figure 18:
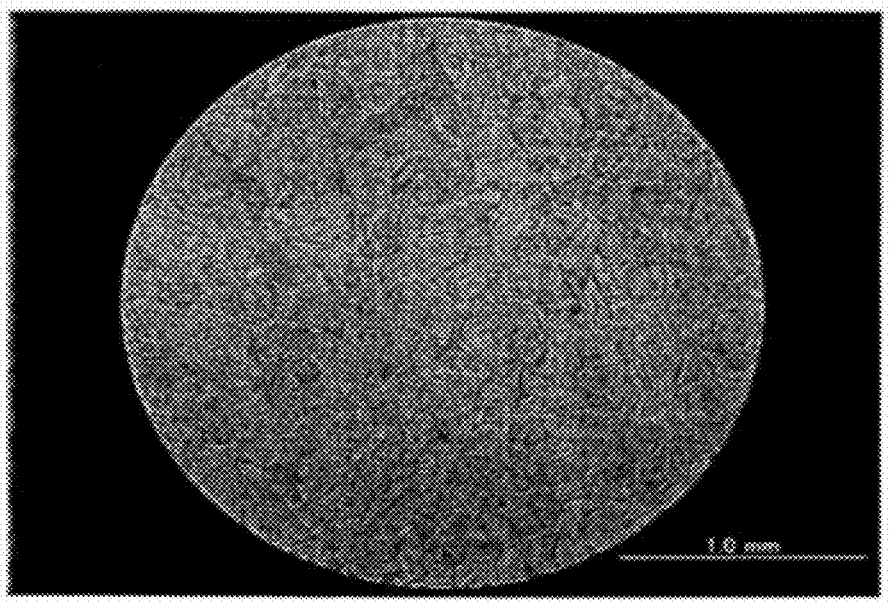
FIG. 18 is a photograph showing a cross section of Comparative Material 15.

In contrast, crystal grains having a substantially equal size all around are uniformly aligned from the surface to the middle portion in the cross section structure of Comparative Material 15 shown in FIG. 18, and secondary recrystallization has proceeded in the entire cross section structure. It is therefore considered that the elongation characteristics of Comparative Material 15 in a high temperature range of not less than 600° C. are lower than those of Example Material 9.

As described above, since Example Material 9 exhibits better elongation characteristics than Comparative Material 15, handling properties are excellent at the time of manufacturing a stranded wire using this conductor, bending resistance characteristics are excellent and it is advantageous in that it is easy to lay a cable due to flexibility.

Although the embodiments and modifications of the invention have been described, the invention according to claims is not to be limited to the above-mentioned embodiments and modifications. Further, please note that not all combinations of the features described in the embodiments and modifications are not necessary to solve the problem of the invention.

INDUSTRIAL APPLICABILITY

According to the invention, it is possible to provide a soft dilute copper alloy material having high conductivity and a long bending life even though it is a soft copper material.

What is claimed:

1. A soft dilute copper alloy material, consisting of:

not lower than 5 mass ppm and not higher than 12 mass ppm of sulfur;

not lower than 7 mass ppm and not more than 30 mass ppm of oxygen;

not lower than 10 mass ppm and not higher than 37 mass ppm of titanium; and a balance consisting of copper and unavoidable impurities, wherein a softening temperature is 130° C. to 148° C., wherein an average crystal grain size is at least 5 μm and not more than 20 μm in a surface layer up to a depth of 50 μm from a surface, wherein the average crystal grain size in the surface layer is less than the average crystal grain size in an inner portion located more interiorly than the surface layer, wherein a size of particles precipitated from the titanium, as distributed in the crystal grains, is not more than 1000 nm and a percentage of particles which are not more than 500 nm is not less than 90%, and wherein a wire rod comprising the soft dilute copper alloy material is drawn into a wire so as to have a conductivity of not less than 102% IACS (International Annealed Copper Standard).

2. The soft dilute copper alloy material according to claim 1, wherein a crystalline structure of the soft dilute copper alloy material comprises a recrystallized structure.

3. The soft dilute copper alloy material according to claim 1, wherein the titanium is present precipitated in a crystal grain or at a crystal grain boundary of copper in a form of one or more of TiO, $TiO_2$, TiS, and Ti—O—S.

4. The soft dilute copper alloy material according to claim 1, wherein a portion of the sulfur and the titanium includes a compound or an aggregate in a form of one or more of TiO, $TiO_2$, TiS, and Ti—O—S, and a remaining of the sulfur and the titanium is present in a form of a solid solution.

5. The soft dilute copper alloy material according to claim 3, the TiO with a size of not more than 200 nm, the $TiO_2$ with a size of not more than 1000 nm, the TiS with a size of not more than 200 nm, and the Ti—O—S with a size of not more than 300 nm, as distributed in the crystal grains.

6. A soft dilute copper alloy wire, comprising:

the soft dilute copper alloy material according to claim 1.

7. The soft dilute copper alloy wire according to claim 6, wherein a softening temperature thereof is 130° C. to 148° C. when having a diameter of 2.6 mm.

8. The soft dilute copper alloy wire according claim 6, wherein a plated layer is formed on the surface.

9. A soft dilute copper alloy stranded wire, comprising:

a plurality of ones of the soft dilute copper alloy wire according to claim 6 being stranded.

10. A cable, comprising:

the soft dilute copper alloy wire according to claim 6; and an insulation layer around the soft dilute copper alloy wire.

11. A cable, comprising:

the soft dilute copper alloy stranded wire according to claim 9; and an insulation layer around the stranded wire.

12. A coaxial cable, comprising:

a central conductor formed with a plurality of ones of the soft dilute copper alloy wire according to claim 6 being stranded;

an insulation covering formed on an outer periphery of the central conductor;

an outer conductor comprising copper or a copper alloy arranged on an outer periphery of the insulation covering; and a jacket layer located on an outer periphery of the outer conductor.

13. A composite cable, comprising:

a plurality of ones of the cable according to claim 10 arranged in a shield layer; and a sheath on an outer periphery of the shield layer.

14. A composite cable, comprising:

a plurality of ones of the coaxial cable according to claim 12 arranged in a shield layer; and a sheath on an outer periphery of the shield layer.

15. A soft dilute copper alloy sheet, comprising:

the soft dilute copper alloy material according to claim 1.

16. A soft dilute copper alloy sheet, comprising:

the soft dilute copper alloy material according to claim 1 being shaped and annealed.

17. The soft dilute copper alloy sheet according to claim 16, wherein a crystalline structure of the soft dilute copper alloy material comprises a recrystallized structure.

18. The soft dilute copper alloy sheet according to claim 17, wherein a portion of the sulfur and the titanium includes a compound or an aggregate in a form of one or more of TiO, $TiO_2$, TiS, and Ti—O—S, and a remaining of the sulfur and the titanium is present in a form of a solid solution.

19. The soft dilute copper alloy sheet according to claim 18, wherein the TiO with a size of not more than 200 nm, the $TiO_2$ with a size of not more than 1000 nm, the TiS with a size of not more than 200 nm or the Ti—O—S with a size of not more than 300 nm is distributed in a crystal grain.

20. The soft dilute copper alloy material according to claim 1, wherein an edge of the inner portion is located at the depth of 50 μm from the surface.

21. The soft dilute copper alloy material according to claim 1, wherein the titanium content is not lower than 10 mass ppm and not higher than 25 mass ppm.

* * * * *